US005503541A

United States Patent [19]

Barito et al.

[11] Patent Number: 5,503,541

[45] Date of Patent: Apr. 2, 1996

[54] REVERSE ROTATION PREVENTING CLUTCH

[75] Inventors: Thomas R. Barito, East Syracuse; Cheryl M. Keiling, Syracuse, both of N.Y.

[73] Assignee: Carrier Corporation, Syracuse, N.Y.

[21] Appl. No.: 511,770

[22] Filed: Aug. 7, 1995

[51] Int. Cl.[6] ..... F01C 21/00

[52] U.S. Cl. ..... 418/69; 192/8 R

[58] Field of Search ..... 418/69, 55.1, 55.3; 192/7, 8 R; 417/319

[56] References Cited

U.S. PATENT DOCUMENTS

| | | | |
|---|---|---|---|
| 3,011,606 | 12/1961 | Ferris et al. | 192/8 R |
| 3,518,031 | 7/1968 | Randall | 417/319 |
| 3,774,571 | 11/1973 | Shimanckas | 192/8 R |
| 4,696,630 | 9/1987 | Sakata et al. | 418/55 |
| 4,998,864 | 3/1991 | Muir | 417/410 |
| 5,248,017 | 9/1993 | Schwarzbich | 192/8 R |
| 5,320,507 | 6/1994 | Monnier et al. | 418/55.6 |

FOREIGN PATENT DOCUMENTS 63-248990 10/1988 Japan .

*Primary Examiner*—Charles Freay

[57] ABSTRACT

A counterweight is connected to a driving shaft through a lost motion connection. The shaft is received in a bearing relationship in a fixed member. An axially extending portion of the counterweight coacts with the fixed member to define a pair of chambers which radially vary such that the chambers taper convergingly in a circumferential direction corresponding to the normal direction of rotation of the shaft. Cylindrical pins are located in the chambers and provide a jamming relationship between the counterweight and the fixed member when said shaft tends to rotate in a reverse direction.

8 Claims, 6 Drawing Sheets

LOCK-UP

REVERSE ROTATION PREVENTING CLUTCH

BACKGROUND OF THE INVENTION

Rotary compressors can run in reverse due to pressure equalization taking place through the compressor at shut down as well as due to phase reversal or miswiring. A number of devices are known which permit free rotation in one direction but prevent rotation in the opposite direction. U.S. Pat. No. 4,696,630 discloses a ratchet clutch type reverse rotation prevention device in which a spring loaded rod engages a cavity to prevent rotation in one direction while tracking the cavity containing member in the opposite direction until centrifugal force moves the rod against the spring bias and out of contact. U.S. Pat. Nos. 4,998,864 and 5,320,507 disclose clutches employing cylindrical pins which permit rotation in one direction but jam to prevent reverse motion. U.S. Pat. No. 3,518,031 and Japanese printed application 63-248990 disclose the overriding of the connection to prevent damage to the compressor. The known devices require a number of additional pans and/or have their reliability dependent upon a spring, or the like, which is subject to breakage or wear.

SUMMARY OF THE INVENTION

The present invention modifies the shaft and counterweight such that there is a limited amount of free movement or lost motion between the shaft and counterweight. Recesses are formed in the counterweight for receiving cylindrical pins so that in the preferred embodiment the only additional members added to provide the clutch are the two cylindrical pins. The pins may be located in a cage, if desired, such as to facilitate assembly or due to design requirements.

It is an object of this invention to provide a simplified clutch.

It is a further object of this invention to decouple the shaft from the counterweight to prevent the shaft from wedging into the crankcase bearing.

It is another object of this invention to prevent reverse rotation in a compressor. These objects, and others as will become apparent hereinafter, are accomplished by the present invention.

Basically, limited relative movement between the shaft and counterweight permits a relative acceleration and deceleration therebetween. Additionally, the cylindrical pins, carried by the counterweight, wedge between the counterweight and crankcase hub when the shaft, and thereby the counterweight, moves in the reverse direction such that reverse rotation is prevented. During normal operation centrifugal force acts to move the pins away from contact with the crankcase hub.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
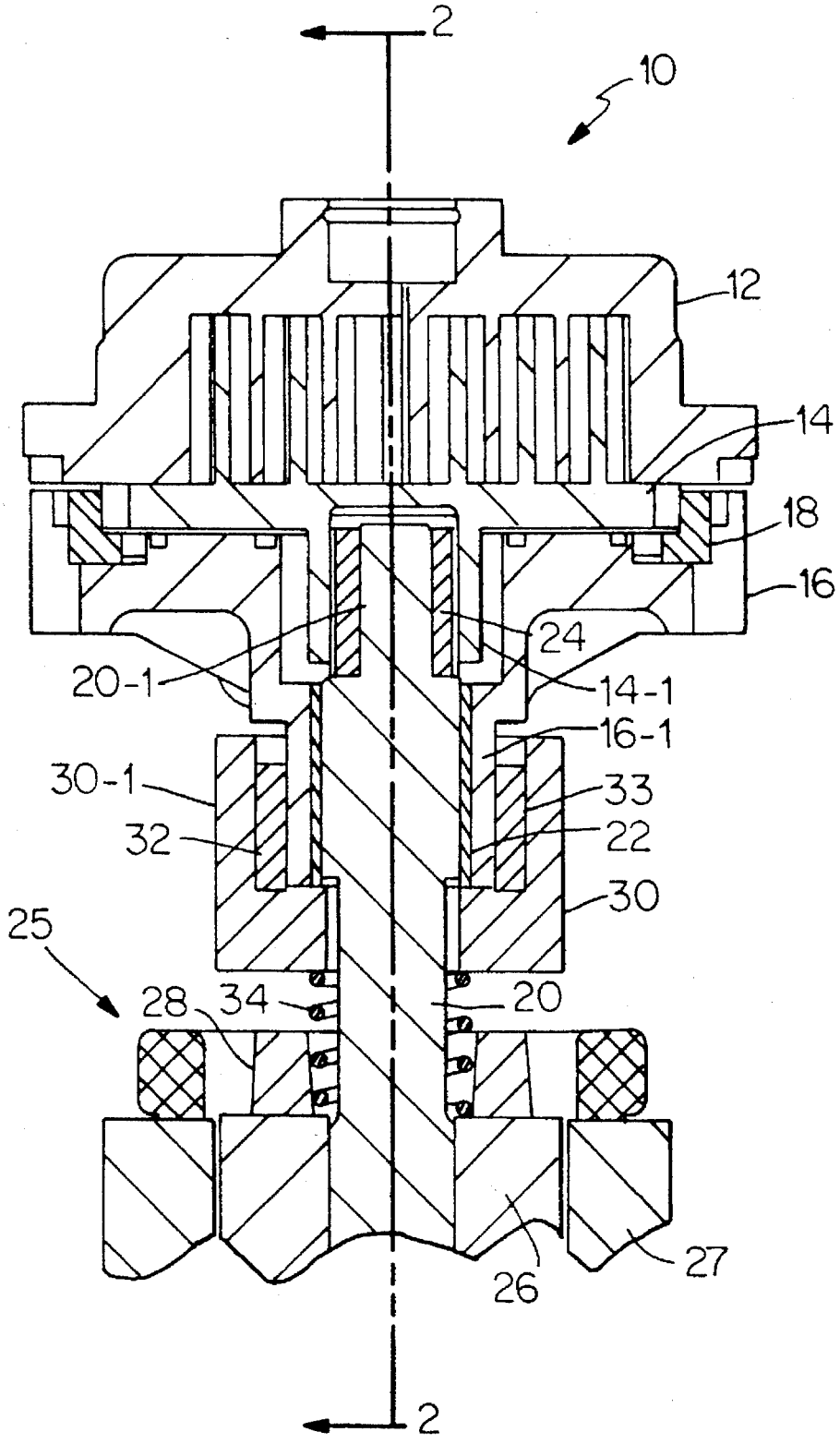
FIG. 1 is a vertical sectional view of a portion of a scroll compressor employing the present invention.
Figure 2:
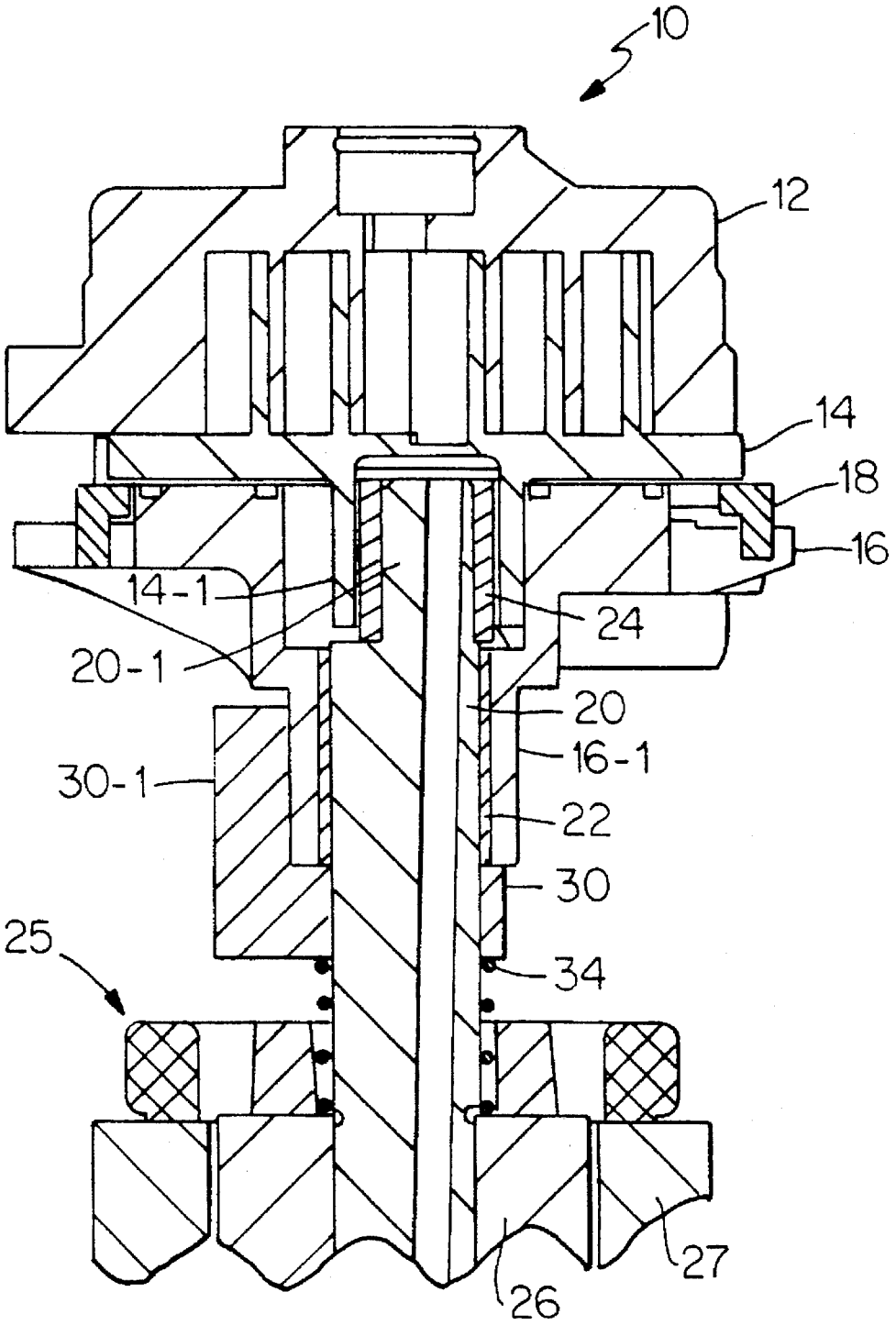
FIG. 2 is a sectional view taken along line 2—2 of FIG. 1.

In FIGS. 1 and 2 the numeral 10 generally designates a low side hermetic scroll compressor. As is conventional, compressor 10 includes a fixed scroll 12, an orbiting scroll 14 and a crankcase 16. Crankshaft 20 is supported by bearing 22 in crankcase 16 and has a pin 20-1 which is received in slider block 24 which is, in turn, received in hub 14-1 of orbiting scroll 14. Rotor 26 is shrunk fit onto shaft 20 while counterweight 30 is axially located on shaft 20 by rotor end ring 28 and spring 34. Alternatively, the counterweight 30 can be located on a shaft step collar or through a pin in a slot. As will be explained in further detail below, there is a small amount of relative circumferential movement that can take place between shaft 20 and counterweight 30. Two cylindrical pins or rollers 32 and 33 are carried by counterweight 30 and are located between the curved axially extending portion 30-1 of counterweight 30 and hub 16-1 of crankcase 16.

In operation, when stator 27 of motor 25 is activated, it causes rotor 26 and thereby shaft 20 and counterweight 30 to rotate. Pin 20-1 coacts with slider block 24 to cause it to rotate therewith in hub 14-1. Orbiting scroll 14 coacts with fixed scroll 12 while being held to an orbiting motion by Oldham coupling 18. The operation described above is conventional and when the motor 25 is stopped there will be a tendency for pressure equalization through compressor 10 by driving orbiting scroll 14 and thereby shaft 20, rotor 26 and counterweight 30 in reverse. Reverse rotation is prevented by the present invention.

Figure 4:
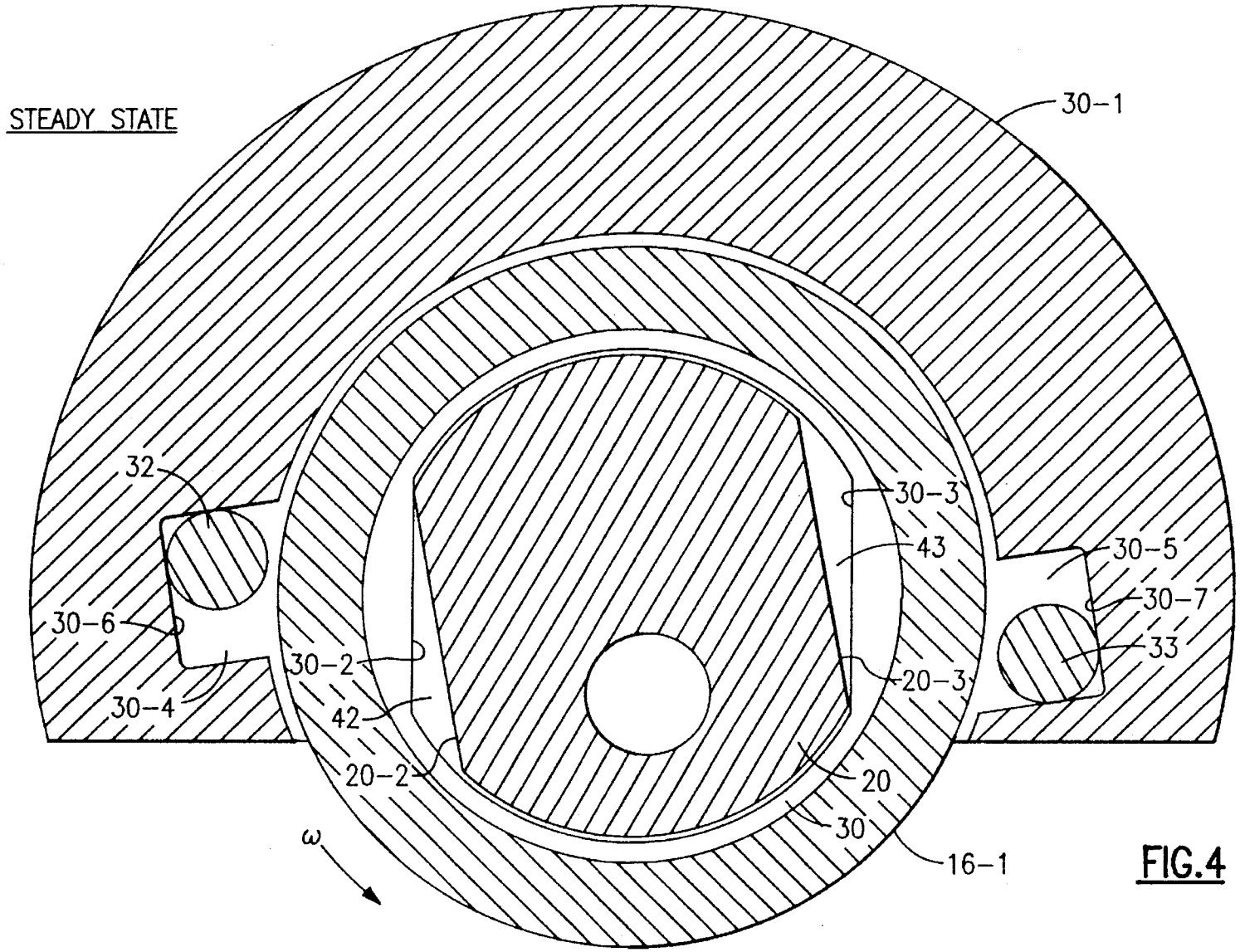
FIG. 4 is a sectional view taken along line 4—4 of FIG. 3 and showing the relative positions of the members in a steady state operating condition.

Referring now to FIG. 4 it will be noted that shaft 20 has two parallel flats, 20-2 and 20-3. Counterweight 30 has a pair of parallel flats 30-2 and 30-3 engageable by flats 20-2 and 20-3. In the steady state relationship of the parts illustrated in FIG. 4, flats 20-2 and 20-3 engage flats 30-2 and 30-3 and define therewith gaps or spaces 42 and 43, respectively. Gaps 42 and 43 represent the potential for relative movement between the shaft 20 and counterweight 30. It will be noted that the structure illustrated in FIG. 4 is moving counterclockwise at a steady rotational speed of $\omega$ and that pins or rollers 32 and 33 have shifted radially outward and in a clockwise direction to the extent permitted by recesses 30-4 and 30-5, respectively. The location of rollers 32 and 33 in recesses 30-4 and 30-5, respectively, of rotating counterweight 30 permits them to move away from contact with crankcase hub 16-1 when they are not needed yet they can accelerate into the narrow portions of the wedges defined by recesses 30-4 and 30-5 with hub 16-1 when needed, i.e. just prior to shaft reversal. This should be contrasted with stationary clutches which require springs to bias rollers into a wedging position and, as a result, always provide an undesirable frictional drag on the rotating member during normal operation.

Figure 5:
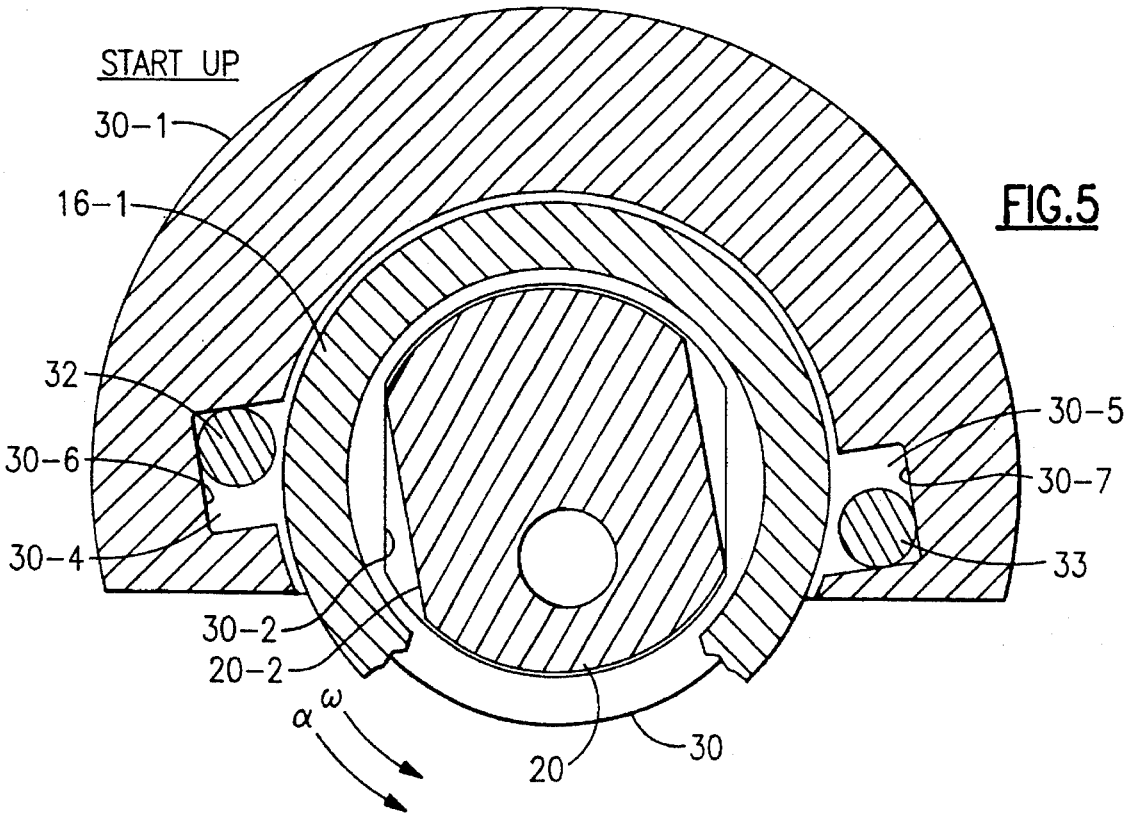
FIG. 5 corresponds to FIG. 4 but with a portion of the hub removed and showing the relative positions of the members at start up.

Turning now to FIG. 5 which represents start up, if, as illustrated, shalt 20 is rotating in a counterclockwise direction, as during normal operation, flats 20-2 and 20-3 drivingly engage flats 30-2 and 30-3, respectively. The shaft 20 and counterweight 30 are moving counterclockwise at a rotational speed of ω and are accelerating at a rate of α. As in the steady state, pins 32 and 33 are located radially outward and in a clockwise direction to the extent permitted by recesses 30-4 and 30-5, respectively. When the steady state is reached, the only difference between FIG. 5 and FIG. 4 is the acceleration, α, in FIG. 5.

Figure 3:
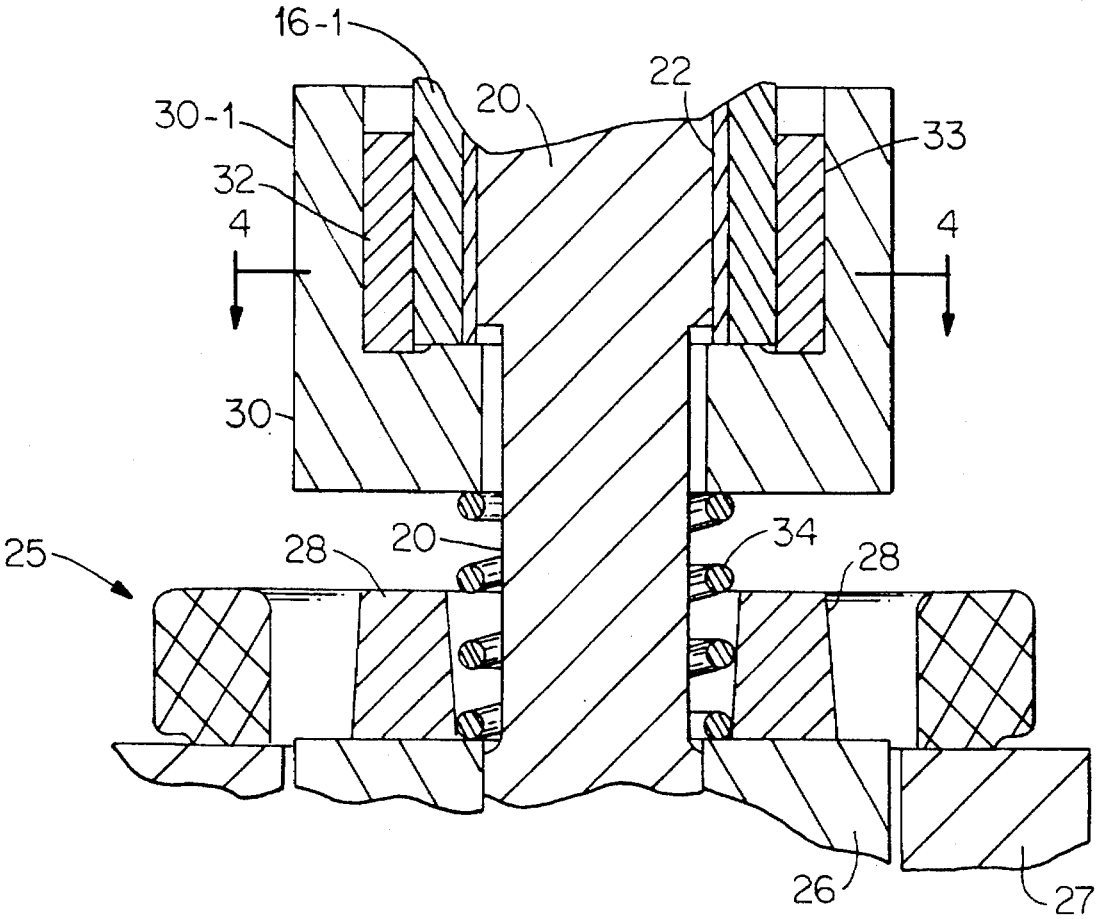
FIG. 3 is an enlarged view of a portion of FIG. 1.

Reverse rotation, as illustrated, is in the clockwise direction for shaft 20 with flats 20-2 and 20-3 drivingly engaging flats 30-2 and 30-3, respectively. Specifically, when the power is interrupted, shaft 20 shifts from the steady state position of FIG. 4 to the FIG. 6 position. The rotational speed is ω in the counterclockwise direction but there is a relative deceleration α in the clockwise direction. Because of the deceleration, the pins 32 and 33 move counterclockwise in recesses 30-4 and 30-5, respectively. The FIG. 6 position, with the members rotating counterclockwise, will continue until the members come to a stop. At that time, pressure acting across the scrolls 12 and 14 will tend to drive orbiting scroll 14 in reverse thereby tending to also drive shaft 20 and counterweight 30 in reverse. In comparing FIGS. 6 and 7 the only difference is in the direction of ω. However, with hub 16-1 being fixed, the cylindrical pins 32 and 33 are located in the narrow ends of tapering recesses 30-4 and 30-5, respectively, in jamming engagement with crankcase hub 16-1 and walls 30-6 and 30-7 of recesses 30-4 and 30-5, respectively. Referring to FIG. 3, the spring 34 acting on counterweight 30 resists canting of the counterweight 30 at lockup as well as providing a bias to return the counterweight 30 to its proper axial position. Note, however, that shaft 20 is decoupled from counterweight 30 thereby preventing shaft 20 from wedging into crankcase bearing 22. It is the wedging of the counterweight 30 and crankcase hub 16-1 through pins 32 and 33 that prevents reverse rotation.

Figure 7:
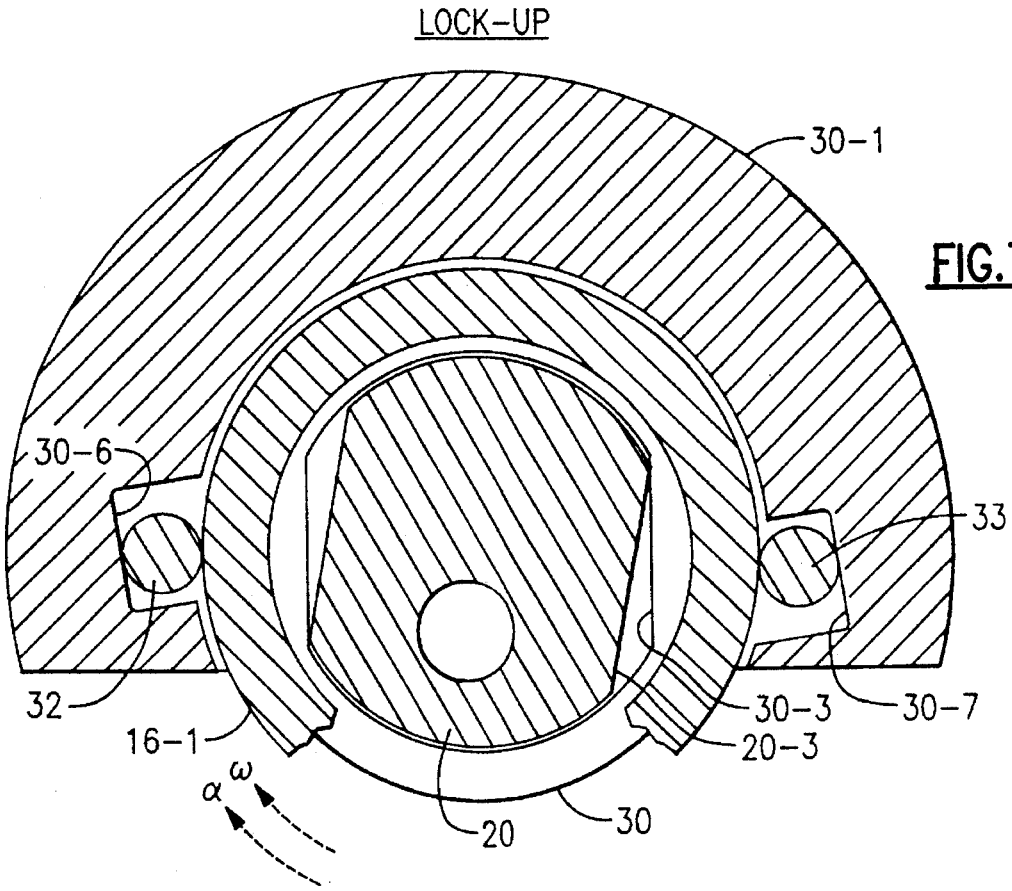
FIG. 7 corresponds to FIG. 4 but with a portion of the hub removed and showing the relative positions of the members at lockup.

At start up, the shaft 20 will rotate counterclockwise from the FIG. 7 to the FIG. 5 position. In going from the FIG. 7 to the FIG. 5 position, only crankshaft 20, of the structure illustrated in FIGS. 5 and 7 will move until flats 20-2 and 20-3 re-engage flats 30-2 and 30-3, respectively, essentially instantaneously accelerating the counterweight 30 up to the speed of the shaft 20. Additionally, tapering recesses 30-4 and 30-5 will move counterclockwise relative to the fixed hub 16-1 such that the narrow ends of tapering recesses 30-4 and 30-5 will be pointing in the direction of rotation. Accordingly, the narrow ends of walls 30-6 and 30-7 are out of contact with cylindrical pins 32 and 33, respectively, which move to the larger ends of recesses 30-4 and 30-5, as illustrated in FIG. 5. In the FIG. 4 position cylindrical pins 32 and 33 are held out of contact with fixed hub 16-1, due to centrifugal and tangential acceleration of the counterweight 30 with respect to the pins 32 and 33 at start up, and offer no retarding action since recesses 30-4 and 30-5 freely receive pins 32 and 33 at their wide end. In contrast, during slow down the pins 32 and 33 move into the narrow ends of recesses 30-4 and 30-5, respectively.

Figure 6:
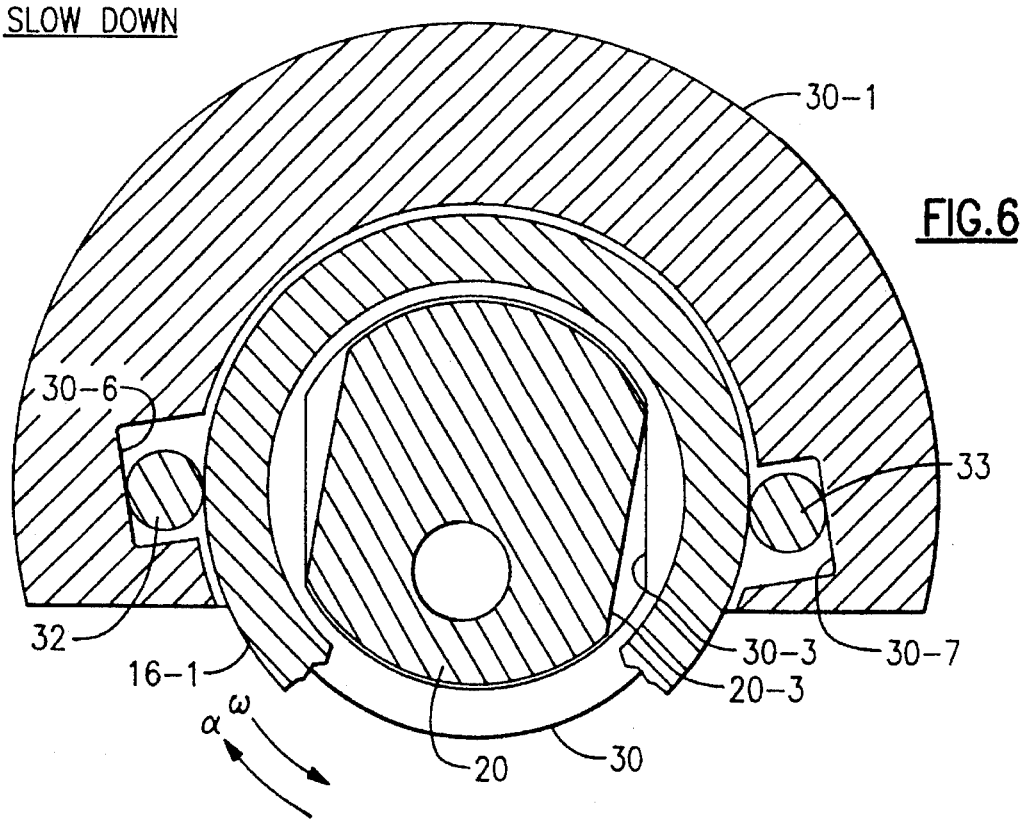
FIG. 6 corresponds to FIG. 4 but with a portion of the hub removed and showing the relative positions of the members during slow down.

FIGS. 6 and 7 are the same except for the direction of rotational speed, ω, and, accordingly, also illustrate the relative positions of members at the instant that the driving force from the motor is overcome by the gas forces acting on the orbiting scroll 14 but before reverse rotation takes place.

Relative to the structure illustrated in FIGS. 6 and 7, at start up only shaft 20 will be initially moved by motor 25 and shaft 20 will move clockwise from the FIGS. 6 and 7 position to the FIG. 5 position where flats 20-2 and 20-3, engage flats 30-2 and 30-3 respectively. Upon re-engagement of the flats 20-2 and 20-3 with flats 30-2 and 30-3, counterweight 30 is essentially instantaneously accelerated up to the speed of shaft 20. Additionally, tapering recesses 30-4 and 30-5 will also move clockwise relative to the fixed hub 16 such that the walls 30-6 and 30-7 at the wider ends of tapering recesses 30-4 and 30-5 are pointing in the direction of rotation. Cylindrical pins 32 and 33 are not being held in place other than by centrifugal force in the FIG. 5 position. Accordingly, there is a lost motion movement of the accelerating counterweight 30 in the clockwise direction before walls 30-6 and 30-7 of recesses 30-4 and 30-5 move into engagement with cylindrical pins 32 and 33 as recesses 30-4 and 30-5 move until pins 32 and 33 are located in jamming engagement with hub 16-1 and walls 30-6 and 30-7, respectively, as illustrated in FIG. 7. The relative rotation of shaft 20 between the two positions engaging flats 30-2 and 30-3 is preferably in the range of 3°–6° as is the motion of counterweight 30 after flats 20-2 and 20-3 move into driving engagement with flats 30-2 and 30-3 and before pins 32 and 33 are in jamming contact with hub 16-1 and walls 30-6 and 30-7, respectively.

Figure 8:
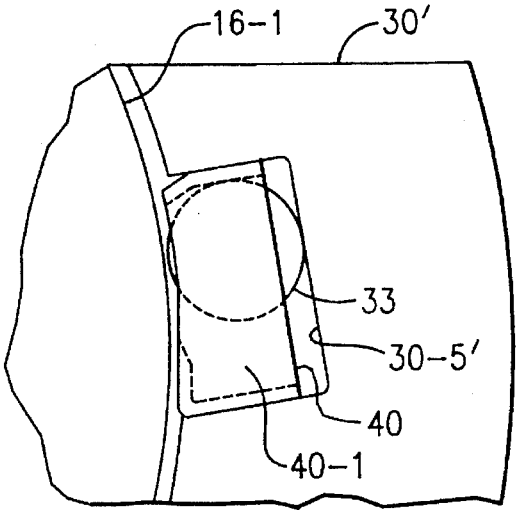
FIG. 8 is a view of a modified embodiment employing a cage.

The structure of FIGS. 1–7 may be modified by providing cages to receive the pins 32 and 33. Specifically, as shown in FIG. 8, pin 33 may be located in a cage 40 which is located in recess 30-5' in counterweight 30'. The cage 40 defines a recess 40-1 which coacts with pin 33 in the same manner as the ends of recess 30-5 in the embodiment of FIGS. 1–7. Pin 33 still coacts with hub 16-1 and counterweight 30' as in the embodiment of FIGS. 1–7. An advantage presented by the use of cage 40 is the greatly reduced criticality of the dimensions of recess 30-5'. Another advantage is that cage 40 can be molded or the like from plastic.

Although a preferred embodiment of the present invention has been described and illustrated, other changes will occur to those skilled in the art. It is therefore intended that the scope of the present invention is to be limited only by the scope of the appended claims.

What is claimed is:

1. In a device having a motor driven shaft having an axis and received in a fixed member in a bearing relationship, reverse rotation preventing means for preventing said shaft and structure driven therethrough from rotating in a reverse direction comprising:

means located on said shaft and connected therewith in a lost motion connection permitting a limited amount of circumferential movement therebetween relative to said axis;

said means located on said shaft having an axially extending portion with said fixed member located between said shaft and said axially extending portion;

at least one axially extending recess in said axially extending portion coacting with said fixed member to define a chamber which radially varies such that said chamber tapers convergingly in a circumferential direction corresponding to an intended direction of rotation of said shaft;

a cylindrical pin located in said chamber and having a diameter at least equal to a minimum radial extent of said chamber and less than a maximum radial extent of said chamber whereby said cylindrical pin jams between said means located on said shaft and said fixed member when said shaft tends to go in said reverse direction.

2. The reverse rotation preventing means of claim 1 wherein said means located on said shaft is a counterweight.

3. The reverse rotation preventing means of claim 1 wherein said lost motion connection permits on the order of 3° to 6° of relative motion.

4. The reverse rotation preventing means of claim 3 wherein said lost motion connection permits relative acceleration and deceleration between said shaft and said means located on said shaft.

5. The reverse rotation preventing means of claim 1 wherein there are two axially extending recesses with a cylindrical pin in each.

6. The reverse rotation preventing means of claim 1 wherein said cylindrical pin is in a cage located in said recess and coacts with said fixed chamber to define said chamber.

7. The reverse rotation preventing means of claim 1 further including means for axially locating said means located on said shaft.

8. The reverse rotation preventing means of claim 7 wherein said means for axially locating includes a spring.

* * * * *